United States Patent [19]

Shum

[11] Patent Number: 4,744,230

[45] Date of Patent: May 17, 1988

[54] KEEPER LOCK FOR A SLIDE FASTENER

[76] Inventor: Yip S. Shum, 194-196 Choi Hung Road, Kowloon, Hong Kong

[21] Appl. No.: 35,876

[22] Filed: Apr. 8, 1987

[51] Int. Cl.[4] ..... E05B 67/38

[52] U.S. Cl. ..... 70/68; 70/74

[58] Field of Search ..... 70/68, 74; 292/DIG. 72; 24/386, 387, 426, 436

[56] References Cited

U.S. PATENT DOCUMENTS

| | | | |
|---|---|---|---|
| 2,411,098 | 11/1946 | Leiss | 292/DIG. 72 |
| 3,319,743 | 5/1967 | Pelavin | 70/68 |
| 3,597,945 | 8/1971 | Feinberg | 70/68 |
| 3,965,706 | 6/1976 | Davis | 70/68 |
| 3,978,697 | 9/1976 | Bako | 70/68 |
| 4,015,457 | 4/1977 | Fukuroi | 70/68 |
| 4,221,027 | 9/1980 | Ode | 70/68 |

FOREIGN PATENT DOCUMENTS

| | | | |
|---|---|---|---|
| 188670 | 4/1956 | Austria | 70/68 |

*Primary Examiner*—Robert L. Wolfe

[57] ABSTRACT

A key-operated locking mechanism for the keeper of a zipper closure for a bank bag or the like, in which the keeper swings fully between the closure and release positions about an axis which is parallel to the axis of the zipper. In addition, the keeper and housing for the locking mechanism are provided with cooperating latch means which permits closure of the keeper, independently of any locking means.

3 Claims, 1 Drawing Sheet

KEEPER LOCK FOR A SLIDE FASTENER

BACKGROUND OF THE INVENTION

The present invention relates to a keeper and lock combination for securing a slide fastener and in particular to a keeper-lock combination for the slide fastener of a flexible money bag or the like.

Bank tellers and messengers for other financial institutions regularly carry and transport relatively large amounts of money in flexible money bags having a slide fastener such as the conventional "ZIPPER". For safety sake, the fastener is provided with a device commonly called a keeper, which in combination with a lock prevents the unauthorized opening or manipulation of the slide fastener. For example, reference can be made to U.S. Pat. Nos. 1,950,414 and 3,653,236, which show conventional keeper and locks combinations and the bags on which they are used. The following area also descriptive of the prior art: U.S. Pat. Nos. 1,950,415; 3,070,986; 3,750,431; 4,403,485.

In general, these and other conventional devices for slide fasteners, provide a horizontally oriented keeper and tumbler lock combination, which is pivotally mounted to move in a plane parallel to and above the lacing element of the slide fastener to close over the bail and pull tab of the lacing element, preventing opening of the slide by manipulation or movement of the lacing element. Authorized release of the lacing element is provided by a key operated lock which when actuated swings the keeper in the horizontal plane away from the back thereby freeing the lacing member for manipulation.

Because the keeper is movable in the horizontal plane from the clearance position into the closure position, and is held therein merely by the locking of the tumbler, the the holding of the lacing element can be easily overcome and the keeper caused to move by a horizontally directed force or by being pried from or distorted out of contact with the lacing element. The construction of the conventional keeper-lock combination is, therefore, not as tamper proof as one might expect.

It is an object of the present invention to provide a keeper-lock combination for a slide fastener of greater security than those heretofore known and in particular, one in which the lock mechanism cannot be overcome by forcing the pivoting of the keeper member.

It is a further object to provide a keeper-lock combination of rugged and durable nature, yet with conveniently arranged parts, and particularly one in which the keeper cannot be easily pried open or loosened.

The foregoing objects together with other objects and advantages are set forth in the following description others will be obvious to the reader.

SUMMARY OF THE INVENTION

The keeper-lock combination of the present invention comprises a keeper which is pivotable at an angle to the slide fastener about an axis parallel to the axis of the slide fastener, and is held in its closure position automatically by a spring loaded bolt acting perpendicularly to the pivot axis. The bolt is normally held in locked position against the keeper opposite to the pivot axis and is releasable only by operation of a key actuated lock mechanism. The lock mechanism controls only the release movement of the bolt, but does not control its closing movement, which is automatic, nor does it control directly the holding of the keeper or its swing movement. Therefore, the keeper cannot be moved forcably or by distortion, or removal of the lock, unless the bolt is first disabled or released.

Full details of the present invention are set forth in the following description and are illustrated in the accompanying drawings.

DESCRIPTION OF THE INVENTION

Figure 2:
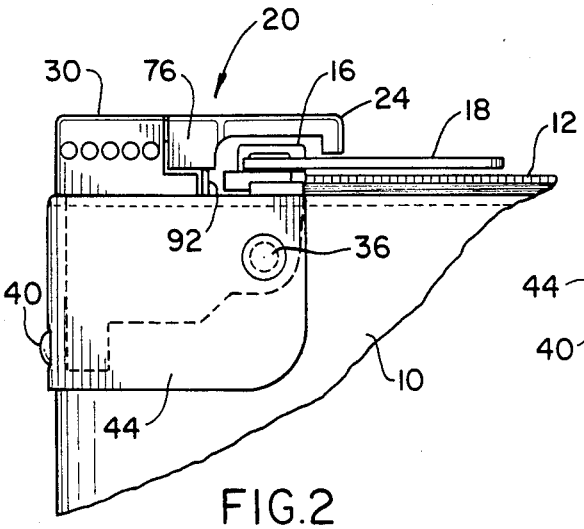
FIG. 2 is an enlarged view of the end of the bag showing the keeper-lock combination.
Figure 1:
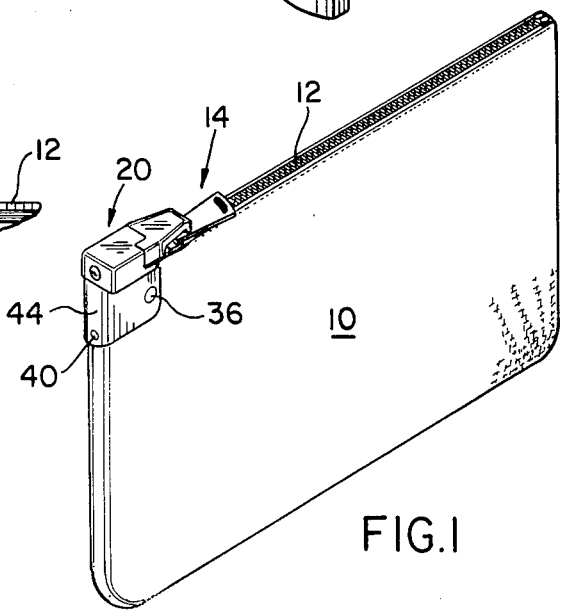
FIG. 1 is an overall view of a flexible money bag having a slide fastener employing the keeper-lock combinmation of the present invention.

In FIGS. 1 and 2, a flexible money bag, generally depicted by numeral 10, is shown. The bag is of the type normally used by bank tellers, messengers or the like, for transportation of money and is in the form of an envelope made of canvas, reinforced plastic or other strong sheet material folded on inself and permanently closed along three edges. The fourth edge, providing an entrance opening into the bag 10, is closable by a conventional slide fastener, generally depicted by the numeral 12 which is sewn in the usual fashion to the material of the bag.

The slide fastener 12 is a conventional zipper type, having two rows of spaced interlocking fingers, which under operation of a slidable closure or lacing element 14, is capable of being swiftly and easily opened or closed. The lacing element 14 is provided with an upstanding bail 16 to which is attached a pivotal pull tab 18 for ease of maniuplation.

As will be obvious from FIGS. 1 and 2, the physical structure of the lacing element 14 prevents the slide fastener 12 from completely closing along its length and thus a small opening or space at the upper left hand corner of the bag would normally remain open. It is the function of the keeper-lock, here generally depicted by the numeral 20, to close this void, and at the same time, engage with and lock the lacing element 14 in fixed position, to prevent unauthorized opening of the slide fastener.

Figure 3:
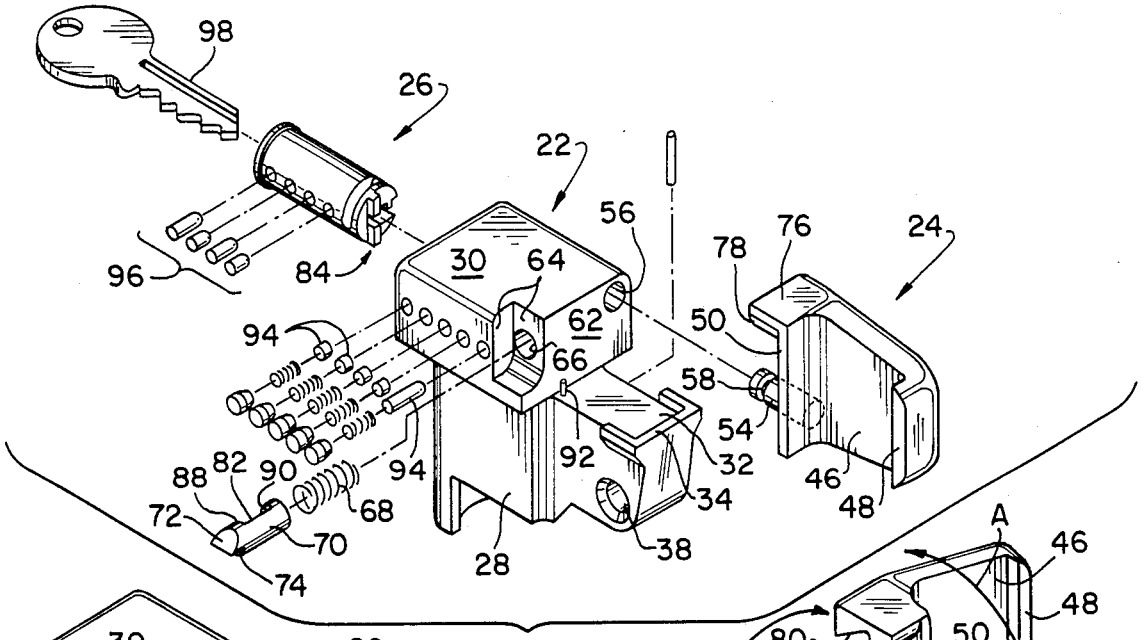
FIG. 3 is an exploded isometric view of the keeper-lock combination shown in FIG. 1.
Figure 4:
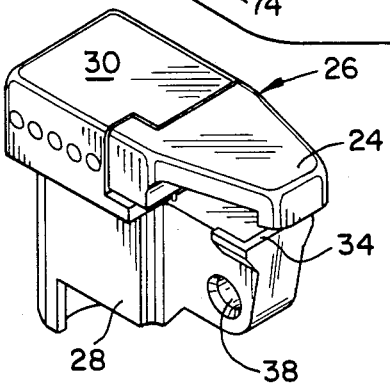
FIG. 4 is an isometric view of the keeper-lock combination in assembled and closed condition.
Figure 5:
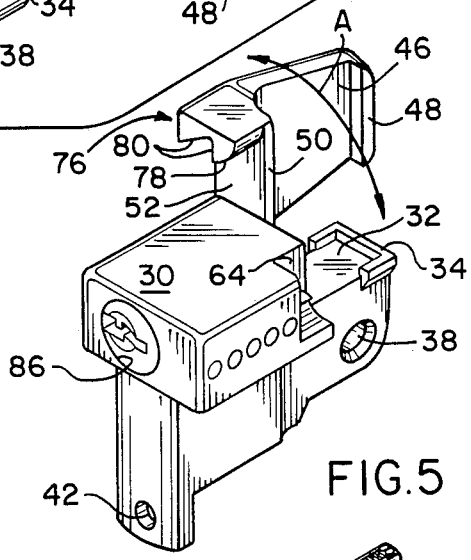
FIG. 5 is an isometric view of the keeper-lock combination, taken from the rear and shown in unlocked condition.

As seen particularly in FIGS. 3–5, the keeper-lock combination 20 of the present invention comprises three principal parts, namely a lock-housing 22, a pivotable keeper 24, and a lock 26 together with a number of interacting elements and their adjunts by means of which the pivotable keeper may releasably secure the lacing element 14 from movement.

The housing 22 is in the form of a solid metalic block, die cast or machined, having a tapered lower body section 30 and a flat rectalinear upper section which sits on the rear half portion of the lower section 28 so as to form, in vertical cross-section, a T-shaped arrangement. The forward half portion of the lower body section 28 has a flat upper surface defining an anvil 32 on which the lacing element 14 of the slide fastener may be placed. The forward end of the anvil 32 is provided with a U-shaped lip 34 to secure the lacing element 14 against axial dislodgement when it is ultimately placed on the anvil 32.

The lower body section 28 is adapted to fit between and within the sides of the bag 10, as shown by the dotted lines in FIG. 2 and is anchored therein by opposing rivets 36 (only one shown) which pass through the sides of the bag 10, into a receiving bores 38 below the anvil 32. A smaller rivet 40 passes through the the bag into a bore 42 in the rear end wall of the lower body section 28. Preferably a decorative retaining plate 44 placed over the outer surface of the bag 10 forming a counter surface for the head of the rivets 36 and 40 and reinforcing the connection of the body 28 to the bag 10.

As seen in FIG. 3, the keeper 24 consists of a plate-like central web 46 having a shallow depending flange 48 at its front end and a somewhat larger depending flange 50 at its rear end. Extending rearwardly from the upper corner of the outer surface 52 of the depending flange 50, is a pivot pin 54 which fits within an elongated socket 56 formed in the upper body section 30 of the housing 22, allowing the keeper 24 to swing reciprocally in the direction shown by arrow A. The pivot pin 54 is provided, adjacent its free end with an annular slot 58 into which a retainer pin (not shown) passes through the upper housing section 30. In this manner, the keeper 24 is held in slidable engagement against the front wall 62 of the upper housing section 30 during its swinging movement. The depth of the flange 50, however, is shallow so that as the keeper 24 swings, the flange 50 does not contact the anvil surface 32. On the other hand, the length of the keeper 24 is somewhat greater than that of the anvil 32 so that the forward flange 48 overlaps the anvil 32 and comes to rest forward of the flange 48 as seen clearly in FIG. 2. In this manner, the keeper 24 is capable of swinging in a direction transverse to the anvil surface 32, as indicated by the double arrow A, between a release position, being at a wide angle with respect to the anvil surface, and a closure position, in which it overlies the anvil surface, leaving a space between the keeper 24 and the anvil surface 32 into which the lacing element 14 fits, the forward flange 48 fitting over the bail 16 and pull tab 18, as seen in FIG. 5.

A recess 64 is formed in the forward corner of the upper housing section 30 from its top surface downwardly parallel to the front wall 62. The recess 64 is provided with a bore 66 extending perpendicular to the axis of the pivot pin 54. Set within the bore 66 is a compression spring 68 and a pin or locking bolt 70, arranged so that the locking bolt 70 is slidable only within the bore 66 to the extent permitted by the compression spring 68. The front edge of the locking bolt 70 comprises a latching pawl consisting of an upper surface 72 which is downwardly and forwardly inclined and a recessed bottom surface 74 which is squarely cut back.

The bolt 70 is adapted to engage with a cooperating latching boss 76, which extends rearwardly from the rear surface 52 of the depending flange 50 of the keeper 24. The boss 76 is shaped so as to fit within the recess 62, as the keeper 24 is swung into the closure position, and has (FIG. 5) a curved surface 78 adapted to engage with the upper inclined surface 72 of the bolt 70, causing the bolt 70 to be pushed to the rear against the compression spring 68. The curved surfaces terminates in a flat table like portion 80, adapted to engage squarely beneath the cut back surface 74 of the bolt 70 once the keeper 24 is placed fully into the closure position. In this closure position or closed condition of the bag 10, the spring 68 biases the bolt 70 outwardly and firmly in locking contact with cam boss 76 preventing movement of the keeper 24. The bolt 70 and spring 68 are hidden and no prying or tampering with them is possible and thus the keeper can not be separated.

To effect on the one hand, permanent locking and on the other hand, authorized retraction of the locking bolt 70, an elongated chordal slot 82 is formed in the side of the locking bolt 70 midway between its length, into which the front end 84 of the lock 26 is adapted to fit, the lock passing through a bore 86 at the rear of the upper body 30. The introduction of the forward end 84 into the slot 82 acts as a key in a keyway, preventing rotation of the bolt 70 in the bore 86. The forward end 84 of the lock 26 is provided with a selectively determined cam configuration which, when the lock 26 is rotated in one direction, has a surface which engages the forward end 88 of the chordal slot 82 thus locking the bolt in locking contact with the boss 76 of the keeper in the same direction as the bias of the compression spring 68, and when rotated in the other direction engages the rear end 90 of the slot 82 causing the bolt 70 to move rearwardly against the outward force of the compression spring 68. The rearward movement of the bolt 70 withdraws its bottom surface 74 from contact with table portion 80 of the boss 76 thus releasing the keeper 24.

To assist in the quick and automatic release of the keeper 24 on retraction of the locking bolt 70, a small pin 92 is set within a small bore, perpendicular to the anvil surface 32, adjacent the wall 62 of the upper body section 30 and aligned with the bottom edge of rear flange 50 on the keeper 24. The small pin 92 is outwardly biased by a compression spring (not shown) so as to be moveable between a depressed position and a limited position. Thus when the keeper 24 is in its down closure position (FIG. 4), the pin 92 is depressed, and the spring is loaded against the keeper 24 so that as soon as the keeper 24 is released from its contact with the bolt 70, the small pin 92 will automatically cause the keeper 24 to pop-up allowing the laceing element 14 to be removed from its seat on the anvil.

The lock 26 is conventional, being provided with a plurality of setable pins 94 cooperating with similarly formed adjustable pins 96 located within the upper section of the housing 30, which pins 94 and 96 are released from engagement with each other by introduction of a specific key 98 within the barrel of the lock 26, all in a well understood manner.

It will be observed from the foregoing that the present invention provides a keeper and lock combination, in which the keeper swings fully between the closure and release positions about an axis which is parallel to the axis of the zipper. In addition, the keeper and housing are provided with cooperating latch means which permits closure of the keeper, independently of any locking means. The key lock is provided to permanently lock the latching means preventing opening of the keeper. The lock is operable, in opening the keeper, to sequentially unlock the latching means and thereafter, disengage the latch. In particular, the key operated lock is not connected to the pivot axel or pin, and its operation does not directly cause any movement in or by the keeper.

Thus, a more secure, but simpler construction is provided, one by which a forcing of the lock will not directly open the keeper, or one by which the keeper can not easily be pried. It is to be noted that the keeper is held in close position by the connection of its pivot axle and oppositely placed latching means.

Various modications, changes and embodiments have been described herein. It is, therefore, intended that the disclosure be taken as illustrature of the invention and not as limiting of it.

What is claimed is:

1. A lock for the zipper of a zippered pouch comprising a narrow housing having a defined longitudinal axis and a taper designed to fit into the pouch at that end thereof where the zipper closes, said housing having a forward section and a rearward section that are aligned along the longitudinal axis thereof, a lock assembly block attached to the rearward section of said housing, said block having a forward face and a rearward face respectively facing the forward and rearward sections of said housing, the width of said block being larger than the width of said housing such that in elevation, said block and housing have a T-shaped configuration, the forward end of said housing being formed with a flat upper surface, a raised lip on leading edge of the last-mentioned surface, a keeper plate formed with a forward depending flange and a rearward depending flange, the rearward flange of said plate carrying a pivot pin which is adapted pivotally to seat in the forward face of said block whereby said plate is adapted to pivot coaxially along the longitudinal axis of said housing from an open position pivoted essentially clear of said flat surface and a closed position spaced from and covering said flat surface with the space thus defined adapted to receive the upstanding bail of the slide fastener, means for releasably locking said plate in the closed position, the length of said plate being such as to place the forward flange thereof outboard and in front of said lip when the same is in the closed position thus to lock the upstanding bail of the slide fastener between said flat surface and plate.

2. The lock of claim 1, said releasable locking means comprising a lock bolt disposed in said housing with one end of said bolt adapted to project from said block, a lock shoulder formed on said rearward flange and positioned thereon so as to engage the last-mentioned end when said plate is in the closed position, and a lock assembly disposed in said block, said lock assembly adapted to move between locked and unlocked positions such that when in the unlocked position, the same maintains said one end of said bolt in said lock shoulder thus to prevent said plate from moving out of said closed position.

3. The lock of claim 1, means for spring loading said plate when said plate is in the closed position so that the same tends to pop open when said releasable locking means releases said plate.

* * * * *